US005109824A

United States Patent [19]

Okamoto et al.

[11] Patent Number: 5,109,824

[45] Date of Patent: May 5, 1992

[54] ELECTROMAGNETIC FUEL INJECTION VALVE

[75] Inventors: Yoshio Okamoto; Yozo Nakamura, both of Ibaraki; Mineo Kashiwaya, Katsuta; Eigi Hamashima, Ibaraki, all of Japan

[73] Assignees: Hitachi, Ltd., Chiyoda; Hitachi Automotive Engineering Co., Ltd., Ibaraki, both of Japan

[21] Appl. No.: 377,250

[22] Filed: Jul. 10, 1989

[30] Foreign Application Priority Data

Jul. 13, 1988 [JP] Japan ..... 63-172739

[51] Int. Cl.[5] ..... F02M 51/08

[52] U.S. Cl. ..... 123/472; 123/432; 239/492; 239/533.12; 239/601

[58] Field of Search ..... 123/472, 470, 445, 432; 239/533.12, 598, 601, 492, 494, 496

[56] References Cited

U.S. PATENT DOCUMENTS

| | | | |
|---|---|---|---|
| 2,995,123 | 8/1961 | Göschel | 123/470 |
| 3,528,613 | 9/1970 | Berlyn | 123/470 |
| 3,531,052 | 9/1970 | Berlyn | 239/533.12 |
| 4,519,370 | 5/1985 | Iwata | 123/472 |
| 4,773,374 | 9/1988 | Kiuchi et al. | 123/470 |
| 4,877,004 | 10/1989 | Nishizawa | 123/432 |

FOREIGN PATENT DOCUMENTS

| | | | |
|---|---|---|---|
| 196807 | 3/1958 | Austria | 239/601 |
| 61-152765 | 9/1986 | Japan . | |

*Primary Examiner*—Andrew M. Dolinar

*Attorney, Agent, or Firm*—Antonelli, Terry, Stout & Kraus

[57] ABSTRACT

An electromagnetic fuel injection valve includes a fuel swirl element disposed upstream of a valve seat for giving a swirl force to fuel, a fuel injection port disposed downstream of the valve seat, fuel dividing device disposed downstream of the fuel injection port for dividing a fuel flow.

8 Claims, 12 Drawing Sheets

$K = D/d$

STARTING CHARACTERISTICS AT WATER TEMPERATURE 30°C

STARTING CHARACTERISTICS AT −30°C

ELECTROMAGNETIC FUEL INJECTION VALVE

BACKGROUND OF THE INVENTION

1. Field of the Invention

The present invention relates to an electromagnetic fuel injection valve capable of supplying fuel to a multi-valve engine in which each cylinder has a plurality of intake valves.

2. Description of the Related Art

There is a copending U.S. application Ser. No. 211,261 filed in the name of Y. Okamoto et al. on Jun. 24, 1988 now U.S. Pat. No. 4,887,769, relating to the electromagnetic fuel injection valve.

An electromagnetic fuel injection valve for use in a multi-valve engine in which each cylinder thereof has two intake valves is disclosed in Japanese Utility Model Unexamined Publication No. 61-152765.

The injection valve of the type described above includes: a fuel direction dividing portion disposed downstream from a single injection hole which performs the metering of fuel, with this fuel direction dividing portion being capable of dividing fuel to be injected from an injection hole. Two branch passages are so disposed so as to be inclined with respect to the axis of the valve through which the fuel passes. The main passage disposed upstream of the fuel dividing portion is disposed upstream of the point at which the walls of the branch passages meet; and the shape of the point is designed to have an acute angle so that the fuel injecting angle and the fuel distribution to each of the branch passages is respectively made to correspond to predetermined values.

In the above-described conventional arrangement, the accuracy can be improved such as to uniformalize the fuel distribution from the main passage to the branch passages and to make the amount of fuel distribution be a predetermined value. In addition, the metering accuracy can be improved since the flow of fuel through the main passage is stabilized. On the other hand, since the shape of the fuel stream atomized from the single injection hole is a bar-like shape, the thickness of the film of the fuel particles after passing through the main passage does not become thin and it is difficult to achieve a mean particle diameter of the atomized fuel of 200 μm and below. Further, there is a problem that a portion of the atomized fuel which has been subjected to the restriction of the fuel direction dividing portion is combined with another portion of the atomized fuel which has not been subjected to the restriction, so that the particle diameter of the atomized fuel increases.

SUMMARY OF THE INVENTION

An object of the present invention is to provide an electromagnetic fuel injection valve for a multi-valve engine capable of distributing the fuel from the injection hole with good efficiency and injecting the fuel with a excellent fine particle characteristics.

Another object of the present invention is to provide an internal combustion engine exhibiting an excellent fuel combustion efficiency.

An electromagnetic fuel injection valve according to the present invention which is capable of attaining the above-described objects includes a fuel swirl element disposed upstream of a valve seat and imparting a swirling force to the supplied fuel, a fuel injection hole disposed downstream of the valve seat and dividing means disposed downstream of the fuel injection hole for dividing a fuel flow.

An internal combustion engine according to the present invention comprises an electromagnetic fuel injection valve according to the present invention, and an air intake valve disposed downstream of said electromagnetic fuel injection valve, wherein an angle of the fuel injection from said electromagnetic fuel injection valve is arranged so that the fuel is injected within intake ports.

The fuel dividing means disposed downstream of the single fuel injection port is capable of dividing and introducing the swirling fuel injected from the single injection port into two large-diameter passages without resulting any loss and injecting the fuel from the outlet port of the dividing means with a desired angle of distribution.

The fuel in the dividing means flows downward with a swirling in the large-diameter fuel passage, and, during flowing, the swirling force of the fuel is enhanced. The so-called flow loss resulting from the wall surface of the dividing means can be sufficiently compensated thereby promoting the fuel be divided into fine particles.

At the outlet of the dividing means, the fuel is distributed by the swirling force, so that a desired atomizing angle is formed. The angle can be optionally set by adjusting the eccentric amount (a distance between the center of the groove and axis of the injection valve) of the grooves of the fuel swirl element mounted upstream of the injection port. The particles of the atomized fuel are concentrated in two directions and does not exist along the axis of the injection valve.

As explained above, since the swirled fuel from the injection port is effectively divided by the dividing means, a combining of the fuel particles is prevented so that a fine particle fuel jet is formed.

DESCRIPTION OF THE PREFERRED EMBODIMENTS

Figure 1:
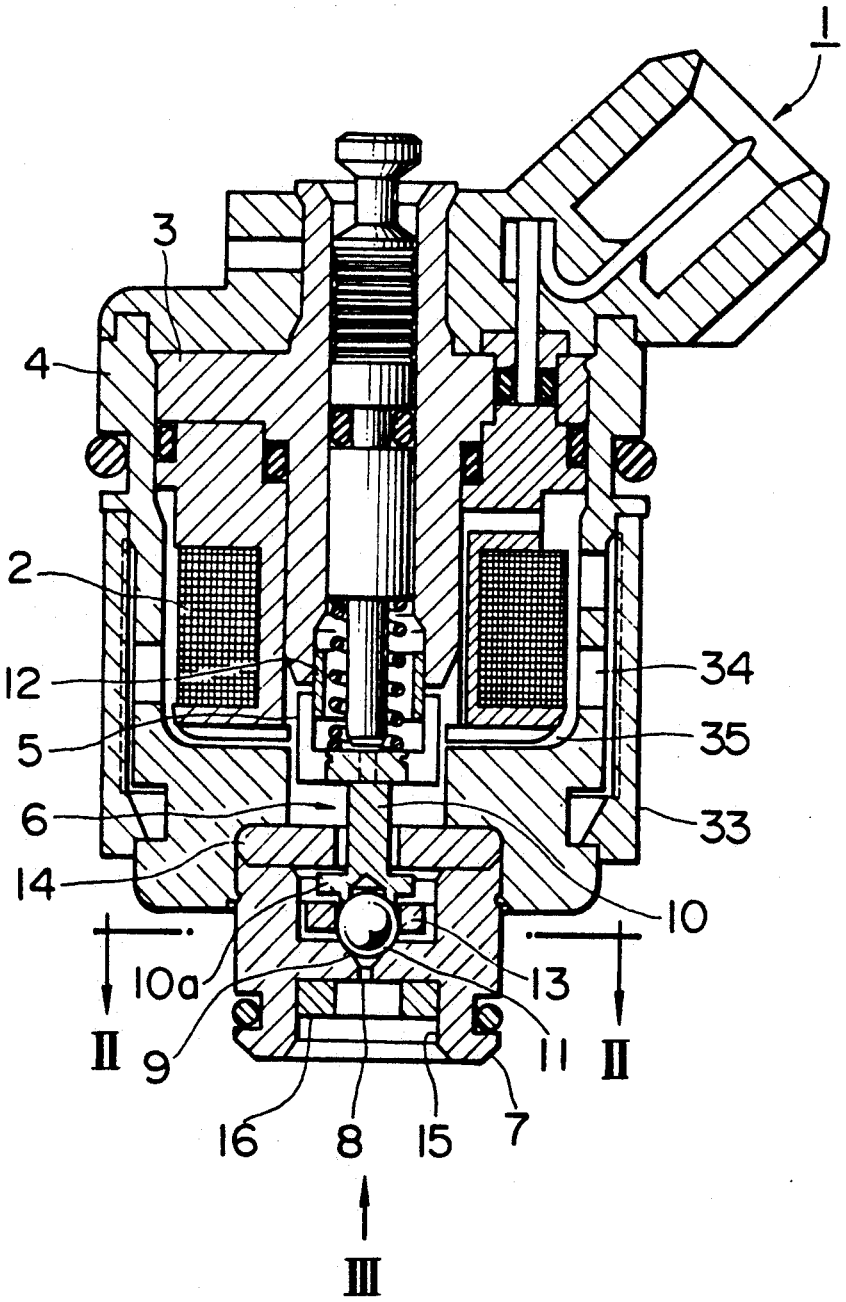
FIG. 1 is a vertical cross-sectional view of an embodiment of an electromagnetic fuel injection valve according to the present invention.

As shown in FIG. 1, an electromagnetic fuel injection valve generally designated by the reference numeral 1 is provided and is adapted to inject and supply fuel by opening and closing the seat portion thereof in response to ON-OFF signals of a duty calculated by a control unit (not shown). Electric signals are supplied to a coil 2 as pulse. When an electric current is passed through the coil 2, a magnetic circuit is formed by a core 3, a yoke 4 and a plunger 5, and the plunger 5 is attracted to the core 3. When the plunger 5 is moved, a ball valve generally designated by the reference numeral 6, integrally formed with the plunger 5, is moved so as to be separated from a seating surface 9 of a valve guide 7. As a result, a fuel injection hole or orifice 8 is opened. The ball valve 6 comprises a rod 10 connected to an end of the plunger 5 made of a magnetic material, a ball 11 which is welded to an end of the rod 10, and a guide ring 12 made of a non-magnetic material and secured to an upper opening portion of the plunger 5. When the thus-formed ball valve 6 is moved, it is guided by both the guide ring 12 and an inner surface of a cylindrical fuel swirl element 13 inserted into a hollow portion formed in the valve guide 7. An amount of stroke of the ball valve 6 is determined by a clearance between a receiving surface 10*a* in a neck portion of the rod 10 and a stopper 14.

On the other hand, a cylinder portion 15, extending in a direction opposite to the seating surface 9, is formed in the valve guide 7. An adapter 16, serving as fuel dividing means, is inserted and secured to the cylinder portion 15.

Figure 2:
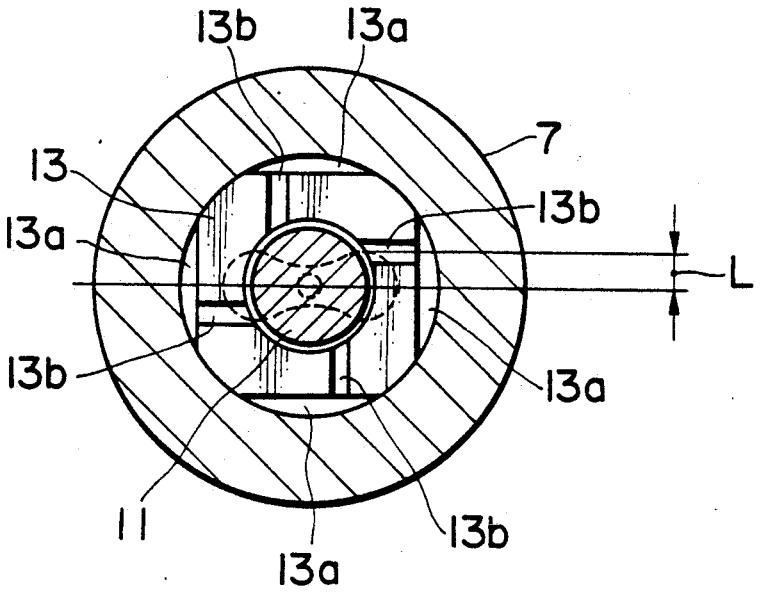
FIG. 2 is a cross-sectional view taken along line II—II of FIG. 1.

As shown in FIG. 2, the fuel swirl element 13 is provided with axial grooves 13*a* and radial grooves 13*b*, with the axial grooves 13*a* being formed by cutting away four surfaces. These grooves 13*a* and 13*b* serve as fuel passages for fuel introduced in the axial direction. The fuel passing through the grooves 13*a* is then introduced into the grooves 13*b* and eccentrically introduced into the orifice 8, so that the fuel is given a so-called "swirl force", with the amount of the swirl force being adjusted by an amount of eccentricity L.

Figure 3:
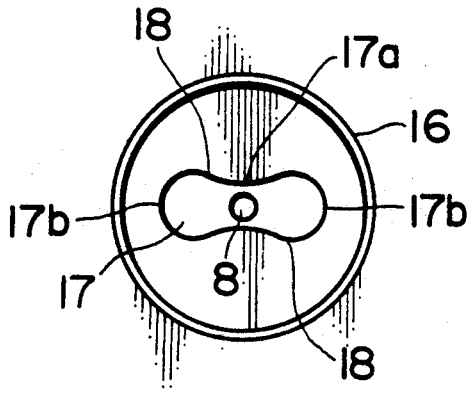
FIG. 3 is a view taken in the direction of the arrow III in FIG. 1 and in which a first embodiment of an adapter according to the present invention is illustrated.

As shown in FIG. 3, the adapter 16 includes a fuel passage 17 at the center thereof communicating with the orifice 8. The profile of the fuel passage 17 is determined by a cylindrical center hole 17*a* having a diameter slightly larger than that of the orifice 8 at the center thereof, two cylindrical holes 17*b* having a relatively large diameter and oppositely and equally spaced with respect to the center hole 17*a*, and circumscribed walls 18 which circumscribe the cylindrical holes 17*a* and 17*b* and have a constant radius of curvature.

Figure 4:
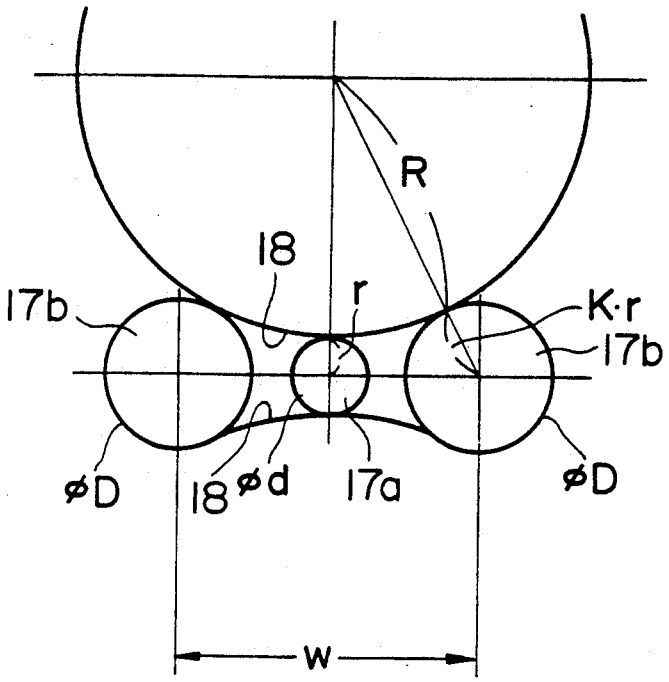
FIG. 4 is a schematic view for determining the shape and dimensions of the adapter.

As shown in FIG. 4, the radius of curvature R of the circumscribed walls 18 is determined by the following equation:

$$R = \frac{0.25\,w^2 + (1 - k^2)r^2}{2(k - 1)r}$$

where:

d is a diameter of the center hole 17*a*, r is a radius of the center hole 17*a*, D is a diameter of the cylindrical holes 17*b*, R is a radius of curvature of the circumscribed walls 18, k is a ratio of diameters of the holes 17*a* and 17*b* (=D/d), w is a distance between the centers of the cylindrical holes 17*b*.

Figure 5:
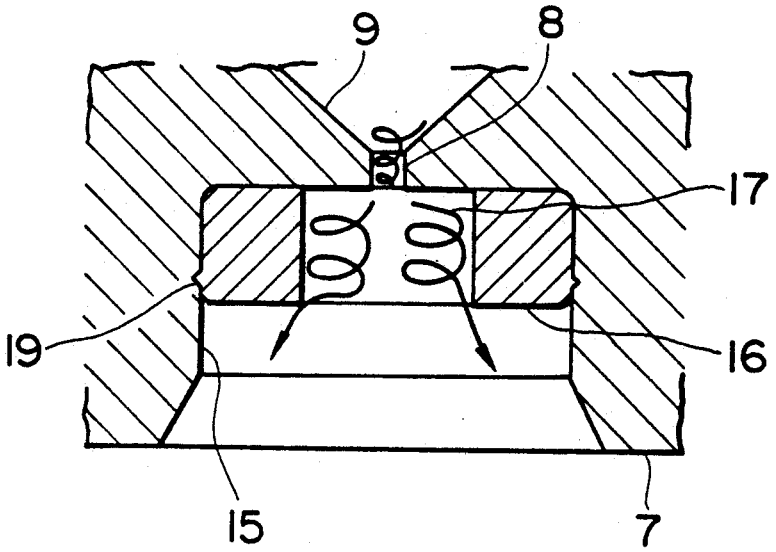
FIG. 5 is an enlarged view of a portion of the adapter.

As shown in FIG. 5, the adapter 16 is secured under pressure to the cylinder portion 15 of the valve guide 7. That is, a so-called "metal flow" method is employed in which the outer surface of the adapter 16 is fitted within the groove 19 formed in the valve guide 7 in such a manner that the material of the adapter 16 is introduced in the radial direction thereof by plastic fluidization as to be secured by pressure realized by this metal flow method.

Fuel is pressurized and adjusted by a fuel pump or a fuel pressure regulator (not shown), and is introduced into the electromagnetic injection valve 1 through an introduction passage 34 via a filter 33. Fuel then passes through a lower passage 35 of the coil 2, outer circumference of the plunger 5, a gap between the stopper 14 and the rod 10 and the grooves 13*a* and 13*b* in the fuel swirl element 13 and is supplied to the seating portion in the swirling motion. When the injection valve 1 is opened, the thus-supplied fuel is injected into an intake manifold through the orifice 8.

Figure 6:
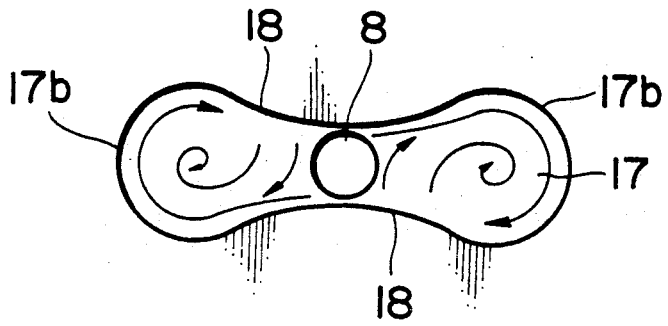
FIG. 6 is a view showing the flow of fuel in the adapter.

Then, as shown in FIG. 5, the swirled fuel injected from the orifice 8, collides with the wall of the center hole 17*a* having a diameter relatively larger than that of the orifice 8, and flows to the cylindrical holes 17*b* by being guided by the circumscribed walls 18, so that swirling flows are generated in the respective cylindrical holes 17*b* so as to result in a generation of a flow as designated by the arrow in FIG. 5. In the fuel passage 17, divided swirling flow are, as shown in FIG. 6, generated in the cylindrical holes 17*b* having a relatively larger diameter.

Figure 7:
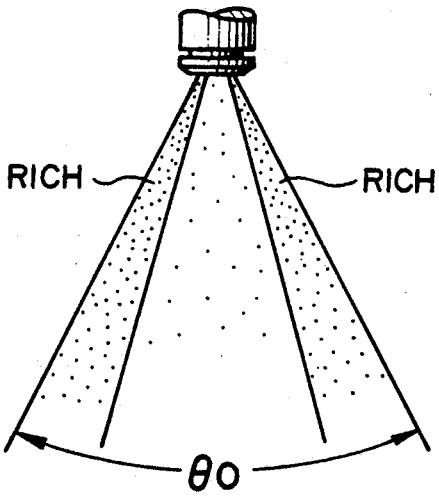
FIGS. 7 and 8 are views showing the state of fuel atomization.
Figure 8:
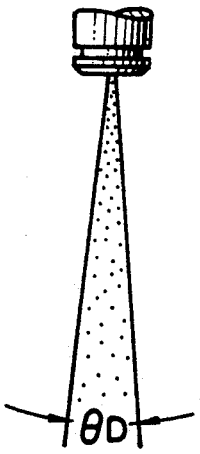

The fuel flow which have passed through the adapter 16 is expanded at an outlet portion of the cylindrical portion 15 resulting in an atomization pattern as shown in FIG. 7. It has been observed that the fuel atomized by the embodiment of FIGS. 1-10 is divided into a two directional flow and the fuel particles included in the flow are fine particles. FIG. 8 is a side view of the flow pattern of the atomized fuel shown in FIG. 7. That is to say, fuel conically atomized from the single orifice 8 is effectively divided into a two directional flow to be a flat atomization pattern including fine fuel particles by the adapter 16. The production of fine fuel particles is promoted by the swirl flow by the fuel swirl element 13 which is sufficient to make up for the loss due to the surface flow along the wall of the adapter 16 and by the fact that a joining or combining of the fuel particles is prevented by the effectively divided swirl flow.

The fuel swirl force can be maintained even if the atmospheric conditions are in a low temperature state (−30° C.) or in a low pressure state (−550 mmHg). Therefore, a generation of any large diameter particles can be prevented.

Figure 9:
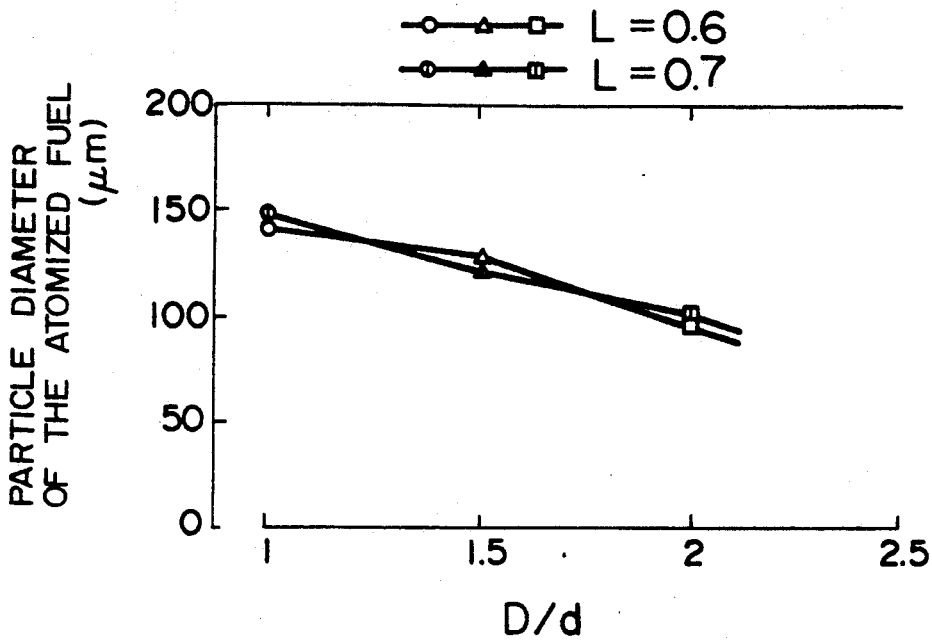
FIGS. 9 and 10 are graphical illustrations showing results of experiments.

FIG. 9 is a graph showing a relation between the diameters of particle diameter of the atomized fuel and the ratio D/d of, where D represents the diameter of the cylindrical holes 17*b* having a relatively larger diameter and d represents the diameter of the center hole 17*a* of the adapter 16. As can be seen, the adapter 16 arranged such that D/d=2 results in the fuel particles having a diameter substantially equal to 100 μm.

Figure 10:
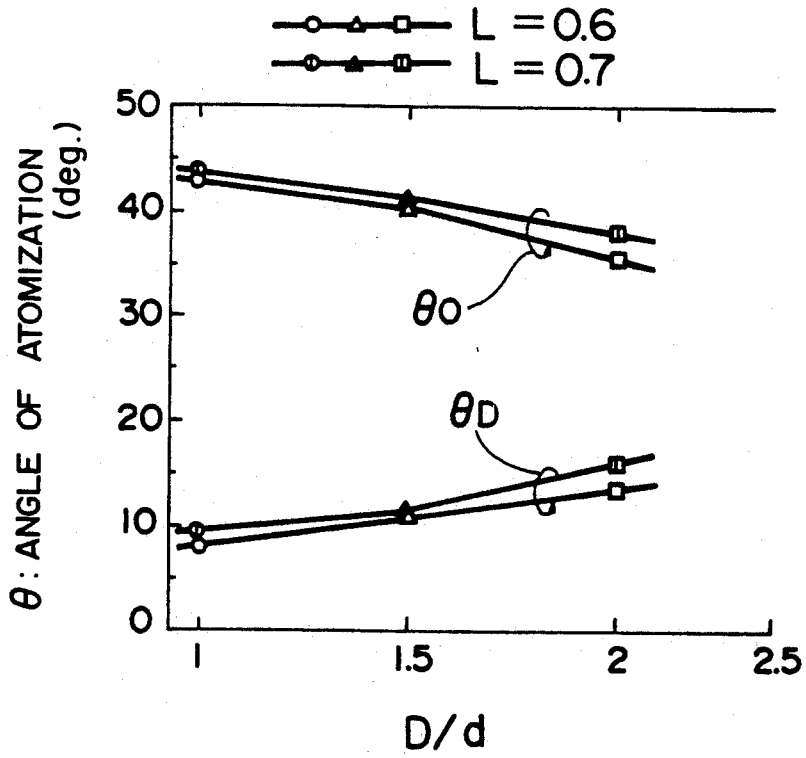
Figure 11:
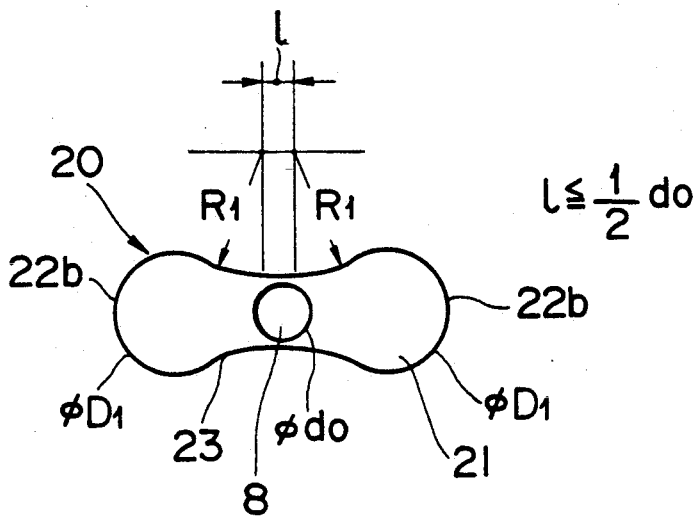
FIG. 11 is a schematic view of a second embodiment of the adapter according to the present invention.

FIG. 10 is a graph showing a relationship between D/d and the angles of atomization of fuel. As can be seen, the angle with respect to the particle diameter of 100 μm becomes such that the outermost angle θo of the atomized fuel is substantially 35° while the angle in the widthwise direction is substantially 15°. Although described previously, the angle of the atomized fuel can be optionally changed by adjusting the swirl force of fuel or by determining the shape and dimensions of the adapter 16 as can be understood from FIG. 10. As shown in FIG. 11, a hole portion 21 of an adaptor 20 includes parallel walls 22*a* arranged to be slightly larger than the diameter of the orifice 8. A distance between the walls opposing to each other corresponds to the diameter of the center hole 17*a* of the embodiment of FIGS. 1–10 and it is expressed by θd in FIG. 11.

The parallel wall 22*a* is arranged to have a length 1 ($1 \leqq \frac{1}{2} d_o$) for the purpose of stably supplying the swirling flow to two large-diameter holes 22*b* (θd1) oppositely and equally spaced with respect to the center of the adapter 20 and in parallel with each other even when the position of the adapter 20 does not perfectly meet the axial center of the injection valve 1. The large-diameter holes 22*b* and the parallel walls 22*a* are communicated with each other by communicating walls 23 each of which has a desired radius of curvature $R_1$. Also in the embodiment of FIG. 11, the performance and effect similar to that obtained in the embodiment of FIGS. 1–10 can be obtained.

Figure 12:
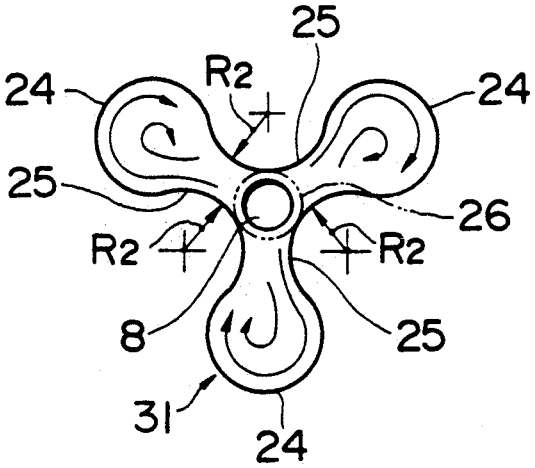
FIG. 12 is a schematic view showing a third embodiment of the adapter according to the present invention.

In the third embodiment of FIG. 12, an adapter 31 is provided having three large-diameter holes 24 communicated with a hole 26 disposed at the axial center of the adapter and having a slightly larger diameter (θd2) than that of the orifice 8 by communicating walls 25 having a radius $R_2$ of curvature. In FIG. 12, the arrows designate the direction of the fuel flow and as is shown, the fuel atomized flow is divided into three directions.

Figure 13:
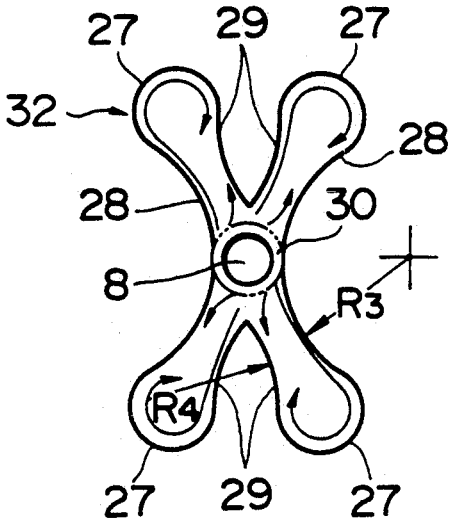
FIG. 13 is a schematic view showing a fourth embodiment of the adapter according to the present invention.

In the embodiment of FIG. 13, an adapter 32 includes four large-diameter holes 27, with two large-diameter holes 27 being respectively disposed on the right side and the left side of the adapter. Each of these large-diameter holes 27 is communicated with a center hole 30 disposed at the axial center of the adapter and having a slightly larger diameter (θd3) than that of the injection hole 8 by communicating walls 28, 29 having radius $R_3$ and $R_4$ of curvature, respectively. In FIG. 13, the arrows designate the direction of the fuel flow, and as in shown, the fuel atomized flow is divided into four directions.

Figure 14:
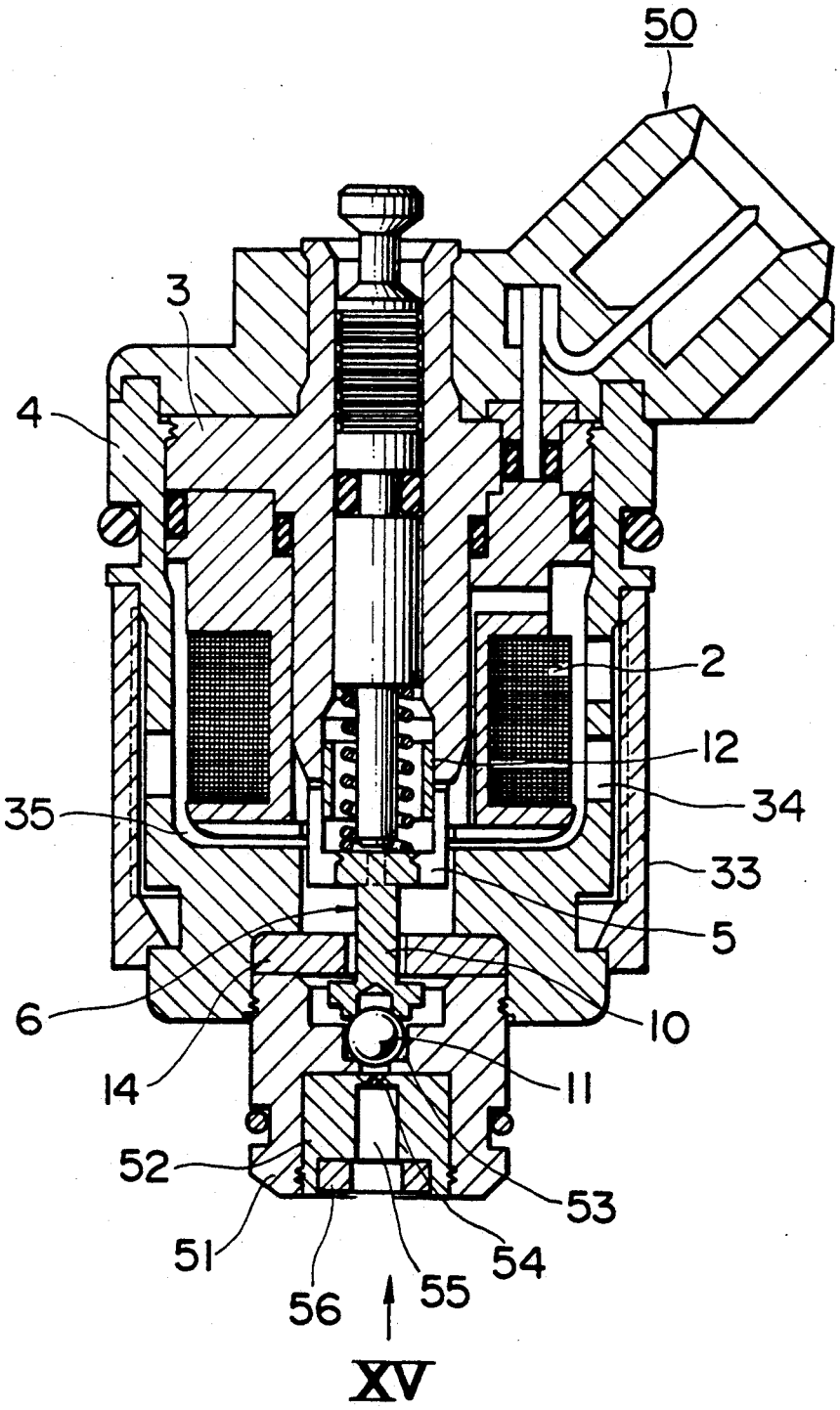
FIG. 14 is a schematic vertical cross-sectional view of another embodiment of the electromagnetic fuel injection valve according to the present invention.

FIG. 14 shows another embodiment of the present invention wherein the same reference numerals as those shown in FIG. 1 represent the same components.

As shown in FIG. 14, an electromagnetic fuel injection valve generally designated by the reference numeral 50 includes a fuel-measuring and swirling elements 52 mounted on a valve guide 51, that is to say, is of a type for injecting fuel in swirl motion downstream of a valve seat 53. A swirl orifice 54 comprises a plurality of small holes. The swirl orifice 54 is opened in the fuel swirl chamber 55 and the plurality of small holes of the swirl orifice 54 are disposed diagonally to the axis of the valve 50. Reference numeral 56 represents an adapter mounted on the lower end of the opening formed in the fuel swirl chamber 55.

Figure 15:
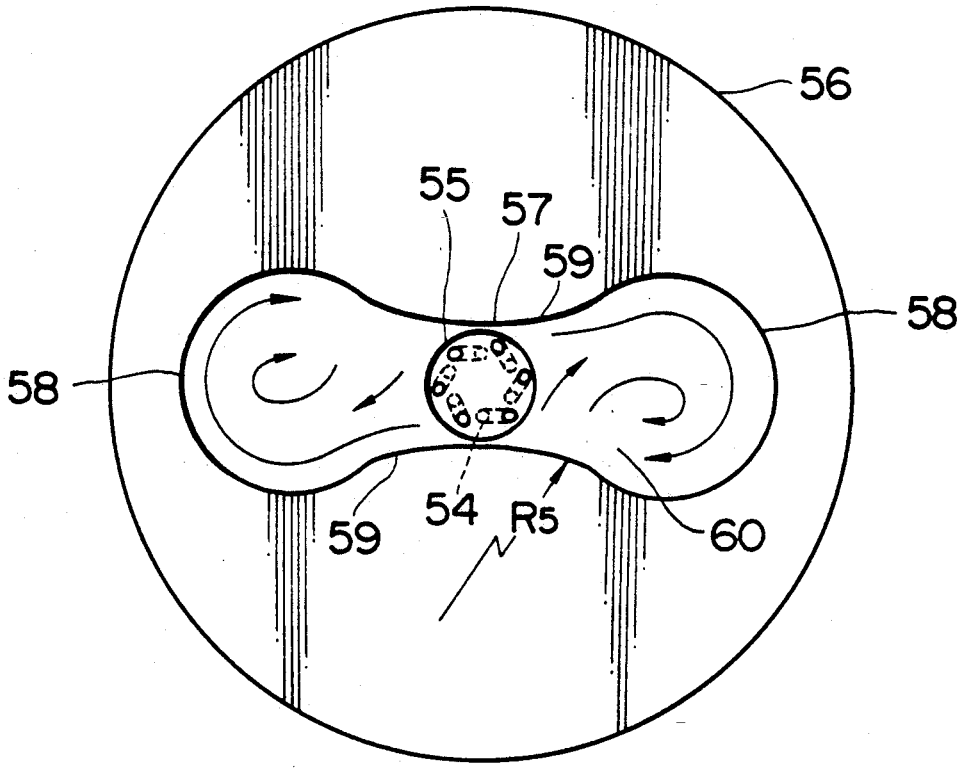
FIG. 15 is a schematic view taken in the direction of the arrow XV in FIG. 14.

In FIG. 15 only the portion concerning an adapter 56 is illustrated. As is similar to the first embodiment as shown in FIGS. 3 and 4, the adapter 56 includes a fuel passage 60 of which profile is determined by a cylindrical center hole 57 having a diameter slightly larger than that of the fuel swirl chamber 55, two large-diameter cylindrical holes 58 oppositely and equally spaced with respect to the center hole 57 and in parallel with each other and circumscribed walls 59 having a radius $R_5$ of curvature.

Arrows shown in FIG. 15 designate the fuel flow. As is shown, the fuel is injected from the swirl orifice 54 disposed in the fuel measuring and swirling element 52 to the fuel swirl chamber 55 in which a swirl force is given thereto. The thus-swirled fuel reaches the fuel passage 60 of the adapter 56 in which the fuel is divided into two directions. Also in the embodiment of FIG. 15, the fuel can be efficiently be divided and the effect achieved is the same as the embodiment of FIGS. 1–10.

Figure 16:
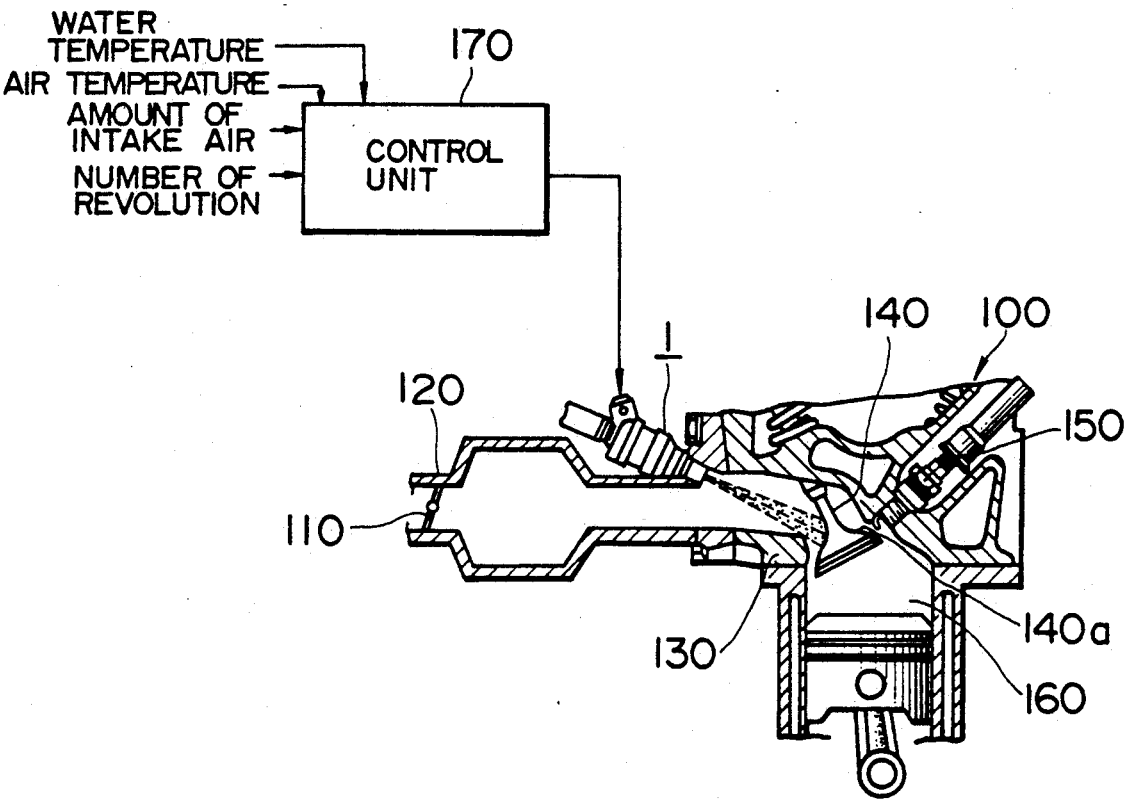
FIG. 16 is a schematic view showing a portion of an internal combustion engine in which an electromagnetic fuel injection valve according to the present invention is employed.
Figure 17:
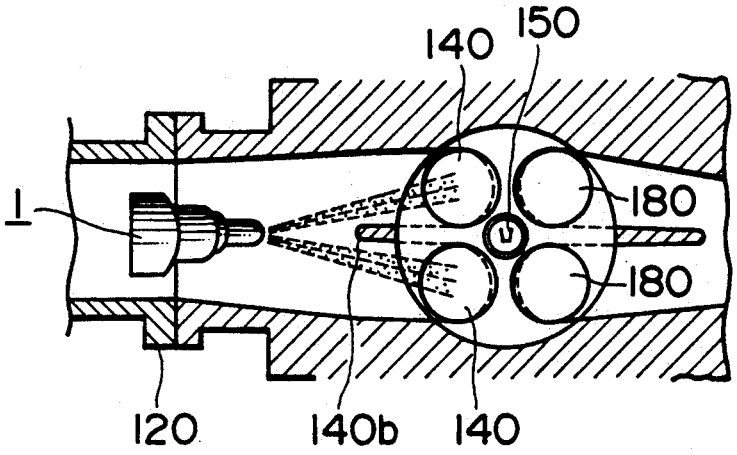
FIG. 17 is a cross section view showing a positional relationship between the fuel injection valve according to the present invention and the suction valve.

FIG. 16 shows an engine control system on which the electromagnetic fuel injection valve 1 according to the present invention is mounted. FIG. 17 shows a state in which the electromagnetic fuel injection valve 1 is mounted.

A DOHC (Double Over Head Camshaft) engine comprises two cam shafts for driving intake and exhaust valves whereby it is easily effected to make the engine high revolution and high power. In particular, in four valve engines, an excellent combustion performance can be obtained since ignition can be conducted in the vicinity of the central portion of the combustion chamber. Furthermore, since a great amount of air can be suctioned into the engine at a time, a significantly high response can be realized. The DOHC engines have a lot of merit as explained above.

A shown in FIG. 16, a DOHC engine 100 comprises an intake manifold 120 including a throttle valve 110, air intake ports 130, air intake valves 140 for opening and closing the air intake ports 130, a fuel combustion chamber 160 in which an ignition plug 150 is faced and the fuel injection valve 1 according to the present invention fixed to the wall portion of the air intake manifold 120 at the position upstream of the air intake valves 140 so that the fuel can be injected toward valve seats 140*a* of the air intake valves 140.

FIG. 17 shows a positional relation between the fuel injection valve 1 and the air intake valve 10. The fuel is atomized in two directions and is injected into the intake ports 130 by the injection valve 1 so as not to collide with a partition wall 140*b* which separates the intake ports 130.

The operation of engine is controlled by a control unit 170 on the basis of the information of operation such as the water temperature, temperature of the partition wall of the fuel chamber 160, amount of suction air, air temperature, and engine speed and so on. The fuel injection from the fuel injection valve 1 is injected in response to a signal transmitted from this control unit 170.

A mixture gas of the fuel and air is introduced from the air intake hole 130 formed in the engine 100 to the combustion chamber 160 in which it is compressed during the compression stroke, and then the thus compressed mixture gas is ignited and subjected to combustion with the ignition plug 150.

Figure 18:
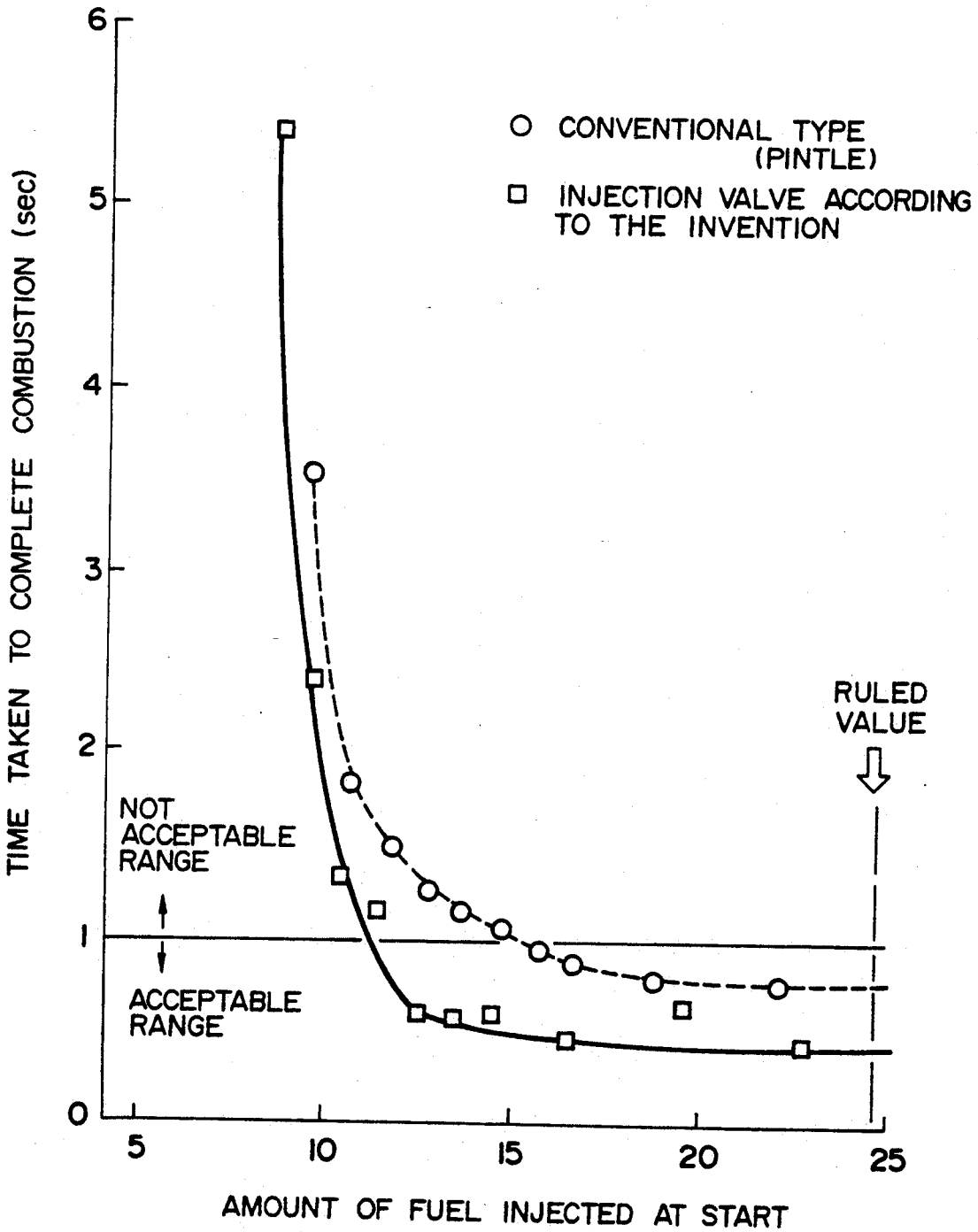
FIGS. 18, 19, and 20 are graphical illustrations showing comparison results between the performance of the electromagnetic fuel injection valve according to the present invention and that of a conventional electromagnetic fuel injection valve.
Figure 20:
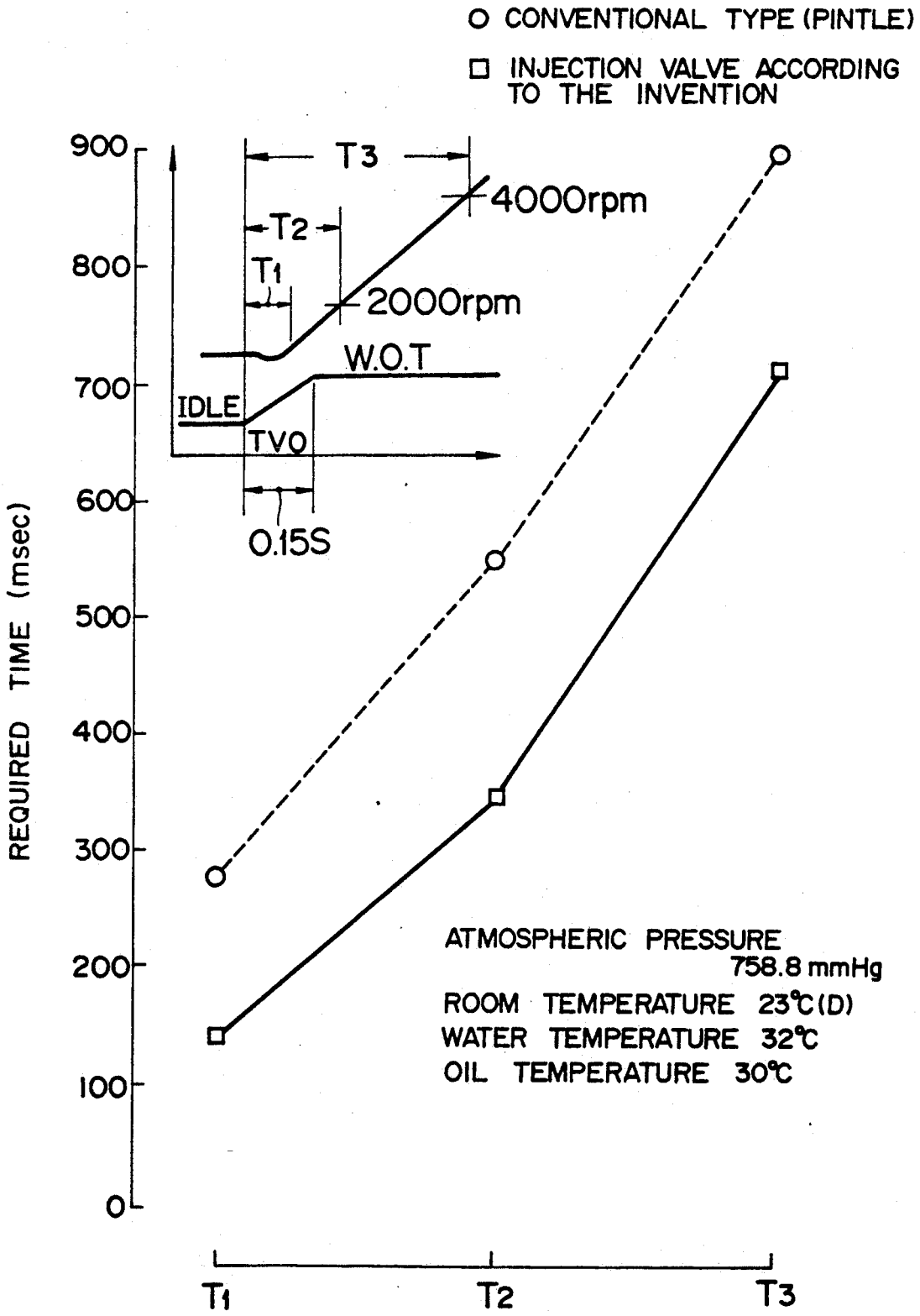

FIGS. 18 and 20 show results of experiments about starting performance in which the fuel injection valve 1 according to the present invention is applied to the engine 100 of the type described above. In order to compare the performance, results of the experiments upon the conventional fuel injection valve (pintle valve) are illustrated together.

Figure 19:
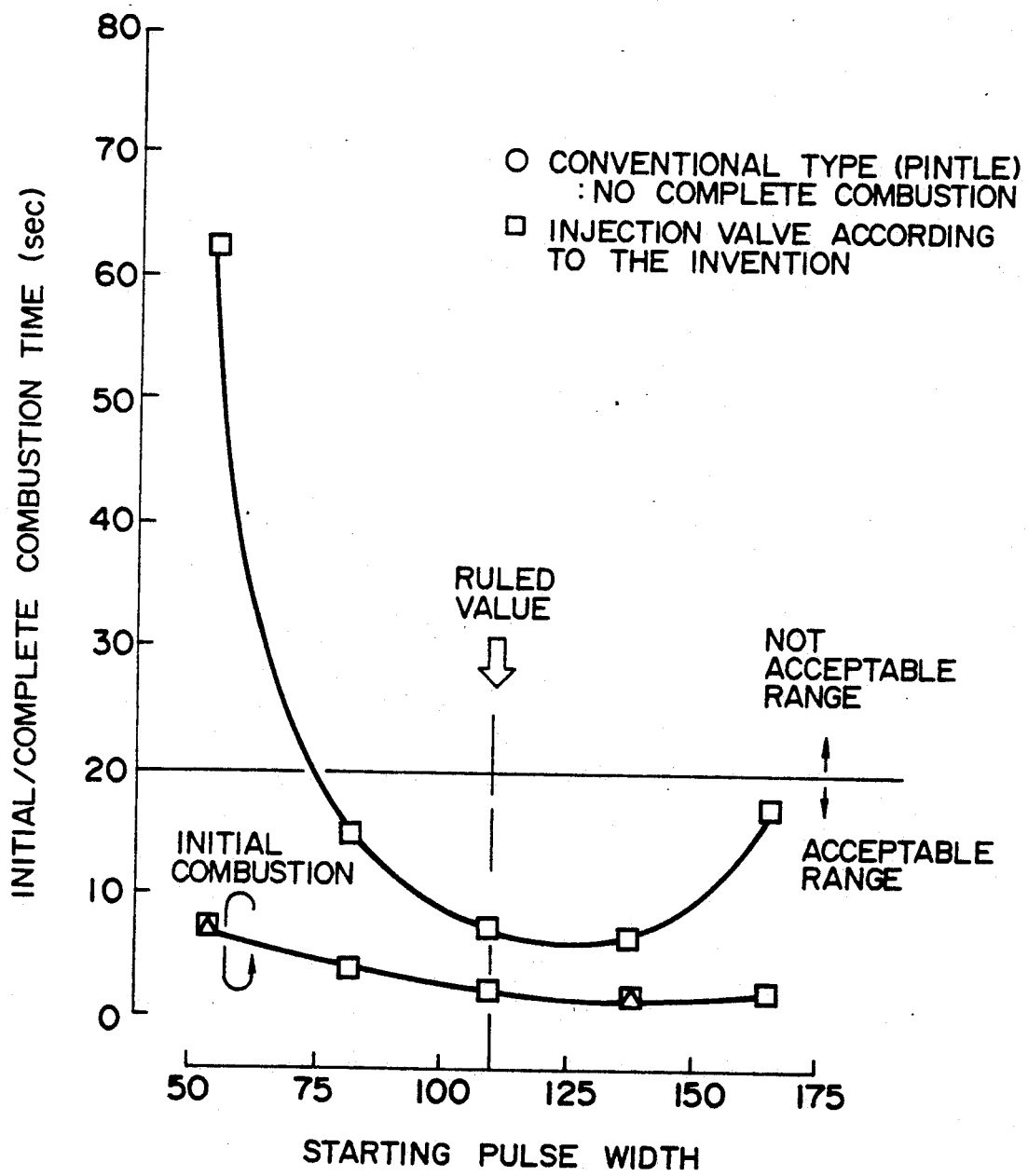

As is apparent from FIGS. 18 and 19, the starting performance due to the injection valve of the invention is significantly improved. In particular, although the conventional pintle valve could not realize a complete fuel combustion when the atmospheric temperature was −30° C., the injection valve according to the present invention caused the initial combustion within several seconds and the complete combustion (range of pulse widths from 90 to 150 ms) within ten seconds.

As the ruled value is within 20 seconds, in the injection valve of the invention, it is possible to set the width of the starting pulse to the degree of 70 msec which is about half of the conventional predetermined value and it is not needed to provide an injector for starting and it is possible to improve the fuel consumption.

FIG. 20 shows a result of the acceleration responsibility test in which the rise of engine speed when the throttle valve was, in 0.15 seconds, opened fully from the idle state is compared. The fuel injection valve according to the present invention can cause the rise in engine speed to be shortened by substantially 150 ms in comparison with the rise of the conventional pintle valve. This demonstrates that the combustion just after the acceleration is extremely quickly effected and that the adhesion of fuel to the partition wall which separates the intake ports and the inner wall of the intake manifold can be avoided and that the fuel injection valve according to the present invention has a superior performance to atomize the fuel into fine particles.

As described above, the fuel injection valve according to the present invention ca provide various practical effects such as improvements in the fuel consumption, starting performance at low temperatures and accelerating performance.

According to the invention, provided are electromagnetic fuel injection valves which have a superior atomization performance to atomize the fuel in fine particles and can divide the fuel from a single injection port into two or more directions effectively and therefore is suitable for the multi-valve engines.

What is claimed is:

1. An electromagnetic fuel injection valve including a fuel swirl element disposed in series flow relationship with a valve seat for providing a swirl force to fuel, and fuel injection orifice means disposed downstream of said valve seat, said electromagnetic fuel injection valve comprising:

dividing means disposed downstream of said fuel injection orifice means for dividing an injected fuel flow by an undivided fuel passage.

2. An electromagnetic fuel injection valve according to claim 1, wherein said fuel passage extends in the same direction as said fuel injection orifice means and has a portion having a constant cross-sectional profile perpendicular to the axis of said electromagnetic fuel injection valve.

3. An electromagnetic fuel injection valve including a fuel swirl element disposed upstream of a valve seat for providing a swirl force to fuel, and fuel injection port disposed downstream of said valve seat, said electromagnetic fuel injection valve comprising fuel dividing means disposed downstream of said fuel injection port for dividing an injected fuel flow, said fuel dividing means including a single fuel passage having a cross-sectional profile perpendicular to an axis of said electromagnetic valve defined by a plurality of first circular arcs disposed symmetrically with respect to said axis of said electromagnetic fuel injection valve and having a diameter larger than a diameter of said fuel injection port and second circular arcs which connect said plurality of first circular arcs.

4. An electromagnetic fuel injection valve according to claim 3, wherein said fuel passage extends in the same direction as said fuel injection port with a portion having a constant cross-sectional profile perpendicular to the axis of said electromagnetic fuel injection valve.

5. An electromagnetic fuel injection valve including a fuel swirl element disposed upstream of a valve seat for providing a swirl force to fuel, and fuel injection port disposed downstream of said valve seat, said electromagnetic fuel injection valve comprising fuel dividing means disposed downstream of said fuel injection port, said fuel dividing means including a single fuel passage having a cross-sectional profile perpendicular to an axis of said electromagnetic fuel injection valve defined by two first circular arcs disposed symmetrically with respect to said axis of said electromagnetic fuel injection valve and having a diameter larger than a diameter of said fuel injection port, and second circular arcs connecting said two first circular arcs.

6. An electromagnetic fuel injection valve including at least one fuel injection orifice means disposed downstream of a valve seat such that said at least one fuel injection orifice means is inclined with respect to an axis of said electromagnetic fuel injection valve, and a fuel swirl element having a fuel swirl chamber for swirling fuel imparted with a swirling force by said at least one fuel injection orifice means, said fuel swirl element being disposed in series flow relationship with said valve seat, said electromagnetic fuel injection valve comprising dividing means disposed downstream of said at least one fuel injection orifice means for dividing an injected fuel flow by an undivided fuel passage.

7. An electromagnetic fuel injection valve according to claim 6, wherein a plurality of fuel injection orifice means are disposed downstream of the valve seat, and wherein each of the fuel injection orifice means is inclined with respect to the axis of said electromagnetic fuel injection valve.

8. A multi-valve engine comprising:

an electromagnetic fuel injection valve including a fuel swirl element disposed upstream of a valve seat for providing a swirling force to fuel, a fuel injection port disposed downstream of said valve seat, and dividing means disposed downstream of said fuel injection port for dividing an injected fuel flow; and air intake valves disposed downstream of said electromagnetic fuel injection valve, wherein an angle of the fuel injection from said electromagnetic fuel injection valve is arranged so that fuel is injected within intake ports of the multi-valve engine.

* * * * *